United States Patent [19]

Vance et al.

[11] 4,000,586

[45] Jan. 4, 1977

[54] SYSTEM FOR MOUNTING ARTICLES TO TELESCOPIC STRUCTURES

[75] Inventors: Richard A. Vance; Robert S. Walworth, both of Champaign, Ill.

[73] Assignee: American Seating Company, Grand Rapids, Mich.

[22] Filed: Apr. 11, 1973

[21] Appl. No.: 349,959

[52] U.S. Cl. ..... 52/9; 297/236; 297/250

[51] Int. Cl.[2] ..... E04H 3/12

[58] Field of Search ..... 52/8–10, 52/36, 710; 297/152, 232, 236, 237, 244, 250, 248; 108/100

[56] References Cited

UNITED STATES PATENTS

| | | | |
|---|---|---|---|
| 2,740,165 | 4/1966 | Ward | 52/8 |
| 2,817,122 | 12/1957 | Walworth | 52/9 |
| 3,025,106 | 3/1962 | Evans | 52/9 |
| 3,077,364 | 2/1963 | Eppink | 297/248 |
| 3,081,718 | 3/1963 | Shoffner | 52/36 |
| 3,429,081 | 2/1969 | Robinson | 52/9 |
| 3,464,753 | 9/1969 | Van Ryn | 297/232 |
| 3,480,240 | 11/1969 | Del Aladice | 52/9 |
| 3,482,874 | 12/1969 | Henebry | 52/8 |
| 3,493,025 | 2/1970 | LaLonde | 52/710 |
| 3,675,594 | 7/1972 | Kritske | 52/588 |

*Primary Examiner*—Price C. Faw, Jr.
*Assistant Examiner*—Henry Raduazo
*Attorney, Agent, or Firm*—Tilton, Fallon, Lungmus, Chestnut and Hill

[57] ABSTRACT

A seating system includes a plurality of telescoping seating sections each including a platform and a rear riser. The rear riser for each seating section includes an elongated continuous metal extruded riser beam which defines a longitudinal slot for mounting the rear legs of folding chairs. The nose portion of each platform also contains a slotted, extruded beam which is located directly above the riser beam of a lower seating section when the system is opened for use. The slots facilitate installation and alignment of the chairs, while the extruded nose and riser beams cooperate to provide rigidity and support for opened seating sections. Additional elements such as hand rails, aisle lights, etc. may be mounted to the slots.

13 Claims, 7 Drawing Figures

FIG. 4
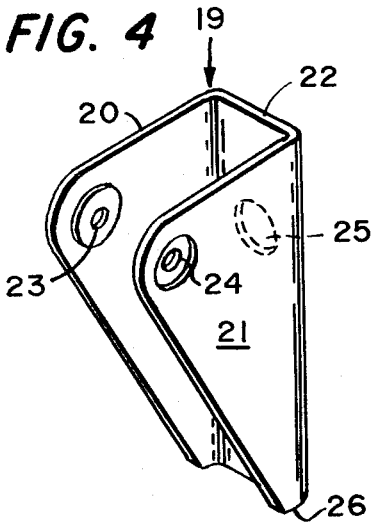
FIG. 3
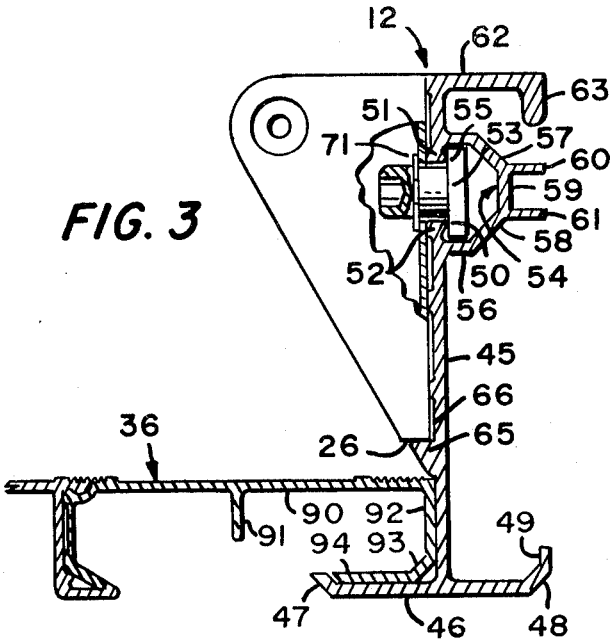
FIG. 5
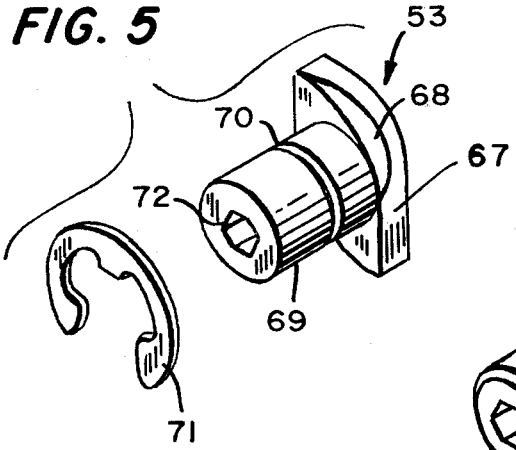
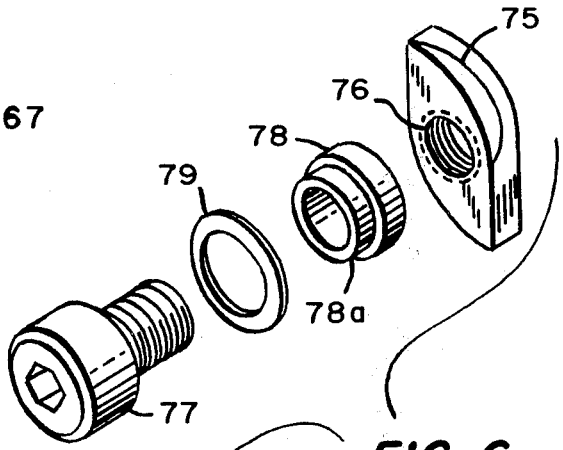
FIG. 6
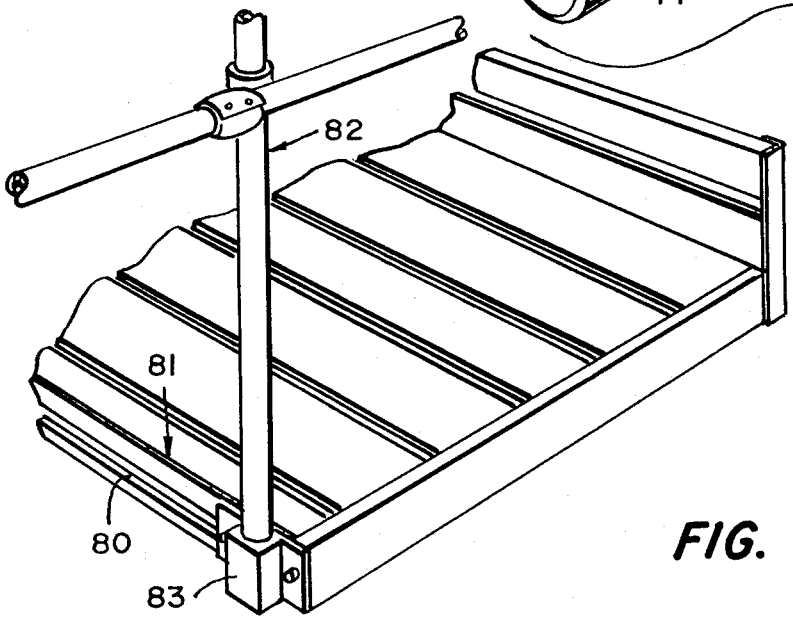
FIG. 7

SYSTEM FOR MOUNTING ARTICLES TO TELESCOPIC STRUCTURES

BACKGROUND AND SUMMARY

The present invention relates to telescoping seating systems; and more particularly it relates to a telescoping seating system which includes a plurality of telescoping "seating" or "platform" sections on which folding chairs are provided. Each individual chair in a system like this is preferably provided with a back, seat and arms, and it has its rear legs pivotally mounted to the riser of a seating section.

The chairs are folded to a horizontal position, resting on a platform so that when the seating sections are telescoped to a retracted position for storage, the chairs do not interfere with the telescoping action. Chairs of this general type are disclosed in the co-owned U.S. Pat. No. 3,567,276 of Van Ryn, issued Mar. 2, 1971, except that the folding arm structure of the patented chair need not be employed. Of course, other chair structures may equally well be employed with the present invention.

In the past, when folding chairs were mounted to the riser of a platform section, holes were drilled in precisely determined locations to achieve lateral alignment of the chairs as well as to achieve the proper height of the rear chair legs on the riser section. Such precise drilling required considerable amounts of labor to install a telescoping seating system of this type, and each hole drilled in the riser presented a potential weakness point in the platform structure.

The present invention provides an elongated metal extruded beam for the riser, and it is structured to define a horizontal slot for mounting the rear legs of the folding chairs with sliding fasteners. Mounting may be accomplished in any number of ways, but is preferred that a bracket be used to pivotally mount the rear legs of the chairs, and that a quarter-turn bolt and nut be used to secure the bracket to the slot, with the nut riding in the slot and facilitating lateral alignment of the chairs. A similar metal extruded beam is provided in the forward or "nose" portion of each platform section. When the system is extended for use, the nose beam of an upper section overlies the riser beam of the next lower section (except, of course, for the lowest section), and the two beams, acting as lateral beams, cooperate to provide strength to each individual platform section. The riser beams further cooperate with vertical support posts for each section to support the forward end of upper platform sections.

The inventive apparatus for mounting folding chairs to the risers of telescoping platform sections not only facilitates installation and alignment of the chairs, but it permits removal of the chairs for repair or replacement. Further, the location and design of the structure which provides the slot adds mass to the riser beam in the upper third portion of it, thereby adding additional strength and deflection resistance to the platform section. The extrusion includes a lower lip or landing for aligning the rear chair brackets in vertical disposition, thereby making installation still easier, and this lip also serves to restrain the brackets against twisting during installation.

Other features and advantages of the present invention will be apparent to persons skilled in the art from the following detailed description of the preferred embodiment accompanied by the attached drawing wherein identical reference numerals will refer to like parts in their various views.

THE DRAWING

FIG. 3 is a side sectional view, partially cut away, showing one method of installing the chair support brackets;

FIG. 4 is a perspective view of a chair mounting bracket;

FIGS. 5 and 6 illustrate alternate methods for mounting the chair brackets to the riser beam; and FIG. 7 is an upper perspective view showing a riser slot used for the mounting of hand rails.

DETAILED DESCRIPTION

Figure 1:
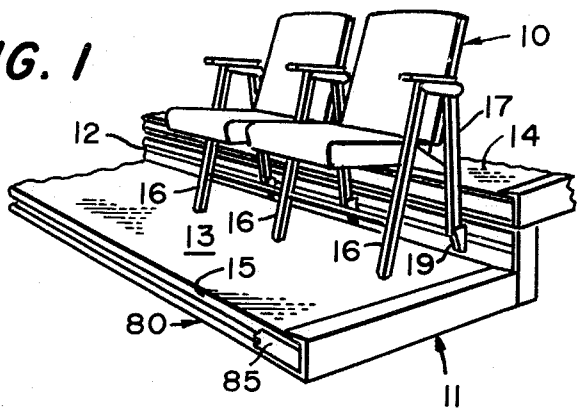
FIG. 1 is an upper perspective view of a telescoping platform section incorporating the present invention.

Referring first to FIG. 1, reference numeral 10 generally designates a pair of folding chairs which are pivotally mounted to a seating section generally designated 11. The chairs may be provided as separate components, or they may be mounted together in groups of two or three if desired. The seating section 11 includes a rear riser 12 and a horizontal platform 13; and as seen in FIG. 1, it is shown in its extended position in which its rear riser 12 extends beneath and supports the forward end of an upper seating section 14. A front riser or "nose" section 15 is located at the forward end of the platform 13; and it forms a vertical continuation of the rear riser for the next lower seating section, best seen in FIG. 2. As explained more fully below, the beams comprising the riser and nose sections for adjacent platform sections cooperate when the system is open for use to strengthen it.

Figure 2:
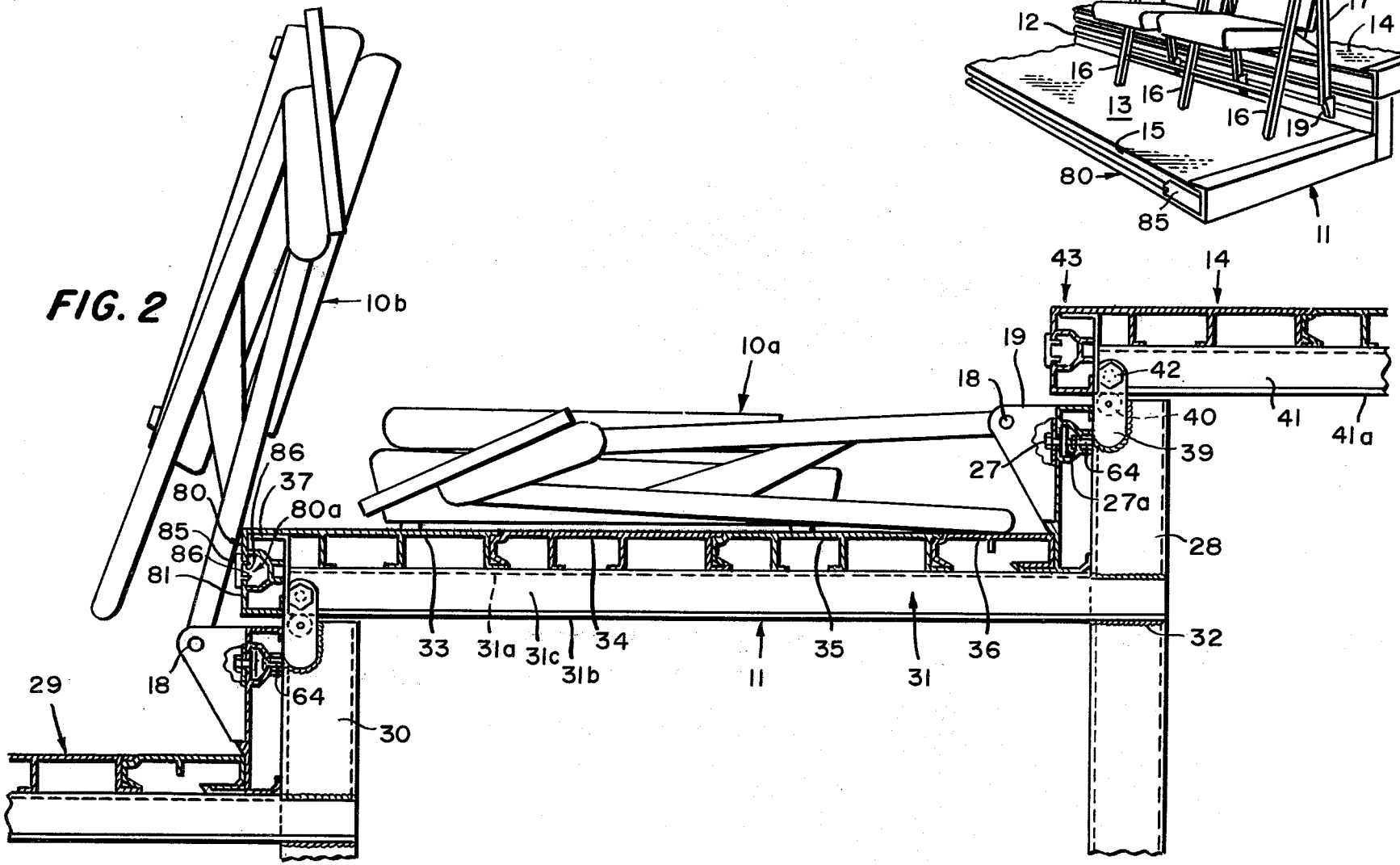
FIG. 2 is a side view of the platform section of FIG. 1, showing the folding chairs in two dispositions.

As already mentioned, the chairs are of a known type which fold vertically and then may be rotated to the horizontal position shown at 10*a* (for storage) or the tiltedback position 10*b* (for cleaning the platform) as seen in FIG. 2. The chairs 10 include forward legs 16 and rear legs 17. The forward legs 16 rest on the platform 13 when the chairs are unfolded to their use position. The lower ends of the rear legs 17 are pivotally mounted by means of a pin 18 (FIG. 2) to brackets 19. As best seen in FIG. 4, the brackets 19 include first and second forwardly extending triangular ears 20 and 21 joined at their rear edges by means of a web 22. The pivot pin 18 is received in bushings 23 and 24 at the upper forward edges of the gears 20, 21. The web 22 is provided with a mounting aperture 25, and it will be observed that the lower horizontal edge of the bracket 19, designated 26 in FIG. 4 forms a horizontal bearing surface for reasons discussed in more detail below. In the embodiment of FIG. 2, the brackets 19 are secured to the riser beams by means of bolts 27 and rectangular plates 27*a*.

Each telescoping section is supported by means of a pair of vertical posts, one of which is shown for the section 11 and designated 28. A corresponding support post for the lower telescoping section generally designated 29 is designated as reference numeral 30. The bottom of the vertical support posts are fitted with conventional wheel channels which carry the telescoping sections between their extended use positions and retracted storage positions. Further, each riser has a pair of supports spaced inwardly of the posts and braced against them as is conventionally done is structures of this type.

A horizontal cantilever member 31 is welded to the post 28 at 32 and extends forwardly thereof to form the support for the platform section 11. The platform itself is provided by a plurality of elongated extrusion sections 33, 34, 35 and 36 which extend longitudinally of the platform and are arranged to interlock with each other. To the forward end of the cantilever arm 31 there is welded an upper riser or nose support bracket 37 having a general shape of an L. The cantilever arm 31, when viewed in cross section, has a generally Z-shape, including upper and lower horizontal flanges 31*a* and 31*b* extending to opposite sides of a vertical central web 31*c*.

Turning now to the right-hand section of FIG. 2, a vertical flange 39 is welded to the top of the post 28 and extends above it. A nylon bearing member 40 is pivotally mounted to the flange 39 (partially housed within the tubular post 28), and it engages and supports the lower flange surface 41*a* of a horizontal cantilever arm 41 of the upper telescoping section 14. The upper portion of the flange 39 is further provided with a stop bolt 42 which extends laterally thereof into the plane of the page of FIG. 2 for engaging the rear portion of an upper riser section 43 of the upper platform 14. This engagement limits the outward extension of the platform section 11 to the position shown in FIG. 2.

Turning now to FIG. 3, the cross sectional details of the rear riser beam 12 for the seating section 11 are illustrated. As mentioned, the rear riser 12 is a continuous metal extrusion, preferably of aluminum, and it includes a central vertical web 45 at the bottom of which a horizontal flange 46 is located. The forward end of the flange 46 includes a slightly upturned edge 47, and the rear end of the flange 46 provided with a similar inclined edge 48 and a vertical upper edge 49.

The upper portion of the web 45, preferably in the upper one-third thereof, there is formed a longitudinal slot 50. The forward face of the slot 50 is provided with upper and lower ridges 51, 52 so that a nut 53 can be received in the slot 50 and (at least in the position shown in FIG. 3) cannot be withdrawn from the slot, being prevented by the ridges 51, 52.

The slot 50 is enclosed by a channel generally designated 54 which includes upper and lower horizontal members 55, 56 centrally inclined portions 57, 58 and a vertical back plate 59.

Upper and lower flange members 60, 61 extend rearwardly respectively from the upper and lower portions of the back plate 59. An upper side flange 62 with a depending foot 63 is located at the top of the web 45, and it extends rearwardly thereof. It will be observed that the right-hand portion of the foot 63 as well as the distal ends of the flanges 60, 61 and the right surface of the upwardly-turned portion 49 of the base flange 46 of the extrusion are in vertical alignment so as to simultaneously abut the front surface of the post 28 (FIG. 2) in aligning the rear riser beam 12.

One of the important features of the present invention is the provision of the shape and location of the slot-forming structure just described, including the slot-enclosing channel 54 which connects the upper and lower portions of the web 45. That is to say, this structure is located within the upper one-third portion of the cross section of the beam, and it therefore adds mass and increases the ability of the beam to resist vertical deflection when the platform is loaded. Secondly, the beam is strengthened to resist transverse deflection by means of the flange members 60, 61; and these two members further act to brace the beam against the vertical supporting posts, as seen in FIG. 2. The beam is secured to the supporting posts 28 as well as to the intermediate supports which are braced against the posts 28 as described above, by bolts 64 which extend through the back plate 59 of the slot channel housing 54. About one-third of the way up the vertical web 45 there is a lip 65 which projects outwardly and forms an upper shoulder 66 on which the lower flat edge 26 of the bracket 19 rests. This lip 66 not only acts to transmit some of the weight of the chair and its occupant to the extrusion beam 12, but it locates the bracket 19 relative to the slot 50 and steadies the bracket during the installation procedure to resist twisting or turning of the bracket.

The brackets may be secured to rear riser beam by bolts 27 and rectangular plates 27 a received in the ends of the slots, as shown in FIG. 2 and described above. Another method of attaching the bracket 19 to the extrusion beam 12 is shown in FIG. 5. The nut 53 is seen to comprise a keeper 67 having a width narrow enough to permit it to be received in the entrance to the slot 50, but having a height large enough so that when the nut is given a quarter turn, as seen in FIG. 3, it will engage the inner portions of the ridges 51, 52 to become secured in the slot. The transition from a relatively narrow width to the relatively long height is smooth, and provided with a cam surface 68 to achieve a non-binding quarter-turn movement. The height of the nut 53 i.e., the longest measurement transverse of the width is sufficient so that it will become lodged between the horizontal members 55, 56 of the slot and not turn freely therein. At the forward end of the nut 53 there is a cylindrical member 69 provided with a circumferential recess 70 into which a spring retainer 71 is pressed after the nut is inserted in the slot. The retainer clip 71 holds the bracket against the beam 12. The outer end of the cylindrical member 69 is provided with a hexagonal cavity 72 for receiving an Allen wrench in turning the nut after the keeper member is inserted in the slot 50.

The arrangement of FIG. 6 is similar to that of FIG. 5 in function, and it includes a similar keeper member 75 which has a central threaded aperture 76 for receiving a threaded bolt 77. A spacer 78 is received over the shaft of the nut 77, and a washer 79 is received over the front, reduced portion 78*a* of the spacer 78 in holding the bracket to the extrusion beam 12.

Returning now to FIG. 2, an upper riser or nose beam 80 is assembled to an supported by the bracket 37; and this nose beam is also a metal extrusion which defines a slot generally designated 80*a* similar to the slot 50, already described. The slot 80*a* is formed in the forward face 81 of the nose beam 80, and this beam also is a structural member, cooperating with the riser beam beneath it when the system is extended for use to strengthen the forward portion of the platform against vertical and horizontal deflection, while at the same time permitting a handrail 82 to be attached by means of a bracket 83 as seen in FIG. 7. The remainder of the slot 80*a* may be covered by a removable vinyl extrusion 85, as illustrated in FIGS. 1 and 2, wherein the back of the vinyl extrusion is provided with inwardly extending flanges 86 which clip into the open forward face of the slot 80*a*. The slot 80*a* may also be used as a conduit for low voltage lighting wires, if desired.

Turning now to the rear portion of the platform 11, as seen in FIGS. 2 and 3, the rearmost floor extrusion member 36 includes a horizontal portion 90 strengthened by means of a center rib 91, a rear vertical portion 92, the bottom of which is inclined as at 93, and then formed horizontally again as at 94. The portions 92–94 are received in the forward hook-like shape of the extrusion beam 12 comprising the lower portion of the vertical web 45, the horizontal portion 46 and the forward upwardly-turned portion 47. The horizontal portion 94 of the platform extrusion 36 may be bolted to the forward portion of the flange 46, but this has not been found necessary. It will also be observed that the lower portion of the lip 65 is located above the horizontal platform portion 90 of the extrusion 36, and it holds and locks the innermost platform extrusion 36.

Having thus described in detail a preferred embodiment of the invention, persons skilled in the art will be able to modify certain of the structure which has been illustrated and to substitute equivalent elements for those disclosed while continuing to practice the principle of the invention; and it is, therefore, intended that all such modifications and substitutions be covered as they are embraced within the spirit and scope of the appended claims.

We claim:

1. In a telescoping seating system including a plurality of telescoping platform sections, the improvement comprising: an elongated metal extrusion forming a lateral beam of said platform sections, said beam including a vertical web defining an elongated horizontal slot; a channel housing providing upper and lower horizontal members extending rearwardly of said vertical web adjacent said horizontal slot, said channel housing being located in the upper third of the vertical center web of said beam, and a vertical back portion in interconnecting the distal ends of said upper and lower horizontal members of said housing; upper and lower horizontal web portions extending rearwardly from said vertical back portion of said housing, said housing shape providing greater beam strength to resist horizontal and vertical deflection; a plurality of folding chairs; and means for pivotally mounting the lower leg portions of said chairs to said beam in said slot, whereby said chairs may be adjusted laterally within said slot.

2. The structure of claim 1 wherein said rearwardly extending horizontal flange portions of said slot channel housing engage the forward edges of the vertical support posts to which said beam is mounted.

3. The structure of claim 2 wherein the lower forward portion of said rear riser beam provides a receptacle for the inboard portion of the platform; said system further comprising a plurality of interlocking platform members for each platform section, the innermost of said platform members coupling to the lower horizontal flange of said rear riser beam.

4. In a telescoping seating system including a plurality of telescoping platform sections, the improvement comprising: a pair of upright support posts for each section carried by carriage means; an elongated metal extrusion forming a lateral beam of said platform sections, each beam defining elongated horizontal slot means therein, said beam including a vertical web portion, a rearwardly extending channel housing for said slot, a lower horizontal flange portion with upwardly-turned distal ends, an upper rearwardly extending flange portion with a downwardly turned distal end; bolt means extending through said slot channel housing for mounting said beam to said upright support posts; a plurality of folding chairs; and means for pivotally mounting the lower leg portions of said chairs to said beam in said slot, whereby said chairs may be adjusted laterally within said slot.

5. In a telescoping seating system including a plurality of telescoping platform sections, the improvement comprising: carriage means for each section including a pair of upright support posts; an elongated metal riser beam connected to the posts of each platform section, each beam defining an elongated horizontal slot therein and including a vertical web defining said slot means integral with said web providing an elongated horizontal bearing surface extending parallel with the direction of elongation of said slot; a plurality of folding chairs; a pair of brackets pivotally attached to each chair, each bracket having a rear mounting plate and further defining a horizontal flat surface for resting on said bearing surface of said beam when assembled thereto, whereby weight of said chairs and occupants is at least partially transferred to said beam by means of said bearing surface and said bearing surface cooperates with said bracket to prevent twisting of said bracket during installation while permitting lateral adjustment of said bracket; and mounting means for attaching said brackets to said beam at said slot.

6. The system of claim 5 wherein said bearing surface of said beam is the upper surface of a lip extending outwardly of said vertical web toward said platform and located beneath said slot, and wherein each bracket rests on said bearing surface of said lip when assembled to said beam at said slot.

7. The structure of claim 5 wherein said mounting means further comprises a quarter-turn nut received in said slot of said beam; and bolt means securing said bracket to said nut.

8. The structure of claim 5 wherein said beam is a rear riser beam and wherein each of said platform sections further comprises a forward nose section, each forward nose section including a horizontally extending extruded metal nose beam defining an elongated horizontal slot, said riser and nose beams cooperating to provide beam strength for said sections when said system is extended for use.

9. A telescopic seating system comprising a plurality of superposed platform sections; support means including upright support posts supporting said platform sections in tiered relation when said support means are extended for a use position and mounting said platform sections in cantilever when said support means are retracted for storage; each platform section including a platform portion, a forward nose portion and a rear riser portion, said rear riser portion comprising a horizontally elongated extruded metal beam secured to its associated upright support posts and defining a continuous horizontal slot adapted for receiving chair mounting means while permitting lateral adjustment thereof; a plurality of folding chairs having lower rear legs; mounting means rigidly securing said chairs to said riser beam at the slot thereof; each of said rear riser beams comprises a vertical central web portion defining a continuous horizontal slot in the upper third thereof, integral housing means behind said slot and adapted to receive a fastener while permitting lateral adjustment of said nut, integral strengthening flange means extending rearwardly from said slot housing, and lower and upper horizontal flange means integral with said vertical central web to provide beam strength.

10. The structure of claim 9 wherein the nose portion of each platform section further comprises a horizontally elongated metal extrusion nose beam defining a horizontal slot adapted for removably mounting appliances thereto while permitting removal.

11. The structure of claim 9 wherein said strengthening flange means of said riser beam extends backwardly to engage said support posts, and further comprising means for fastening said riser beams to said support posts at the rear wall of said channel housing.

12. The structure of claim 9 wherein said cantilever mount comprises a plurality of horizontal slide arms attached to the upper portions of said support posts; tabs mounted to and extending above each of said support posts and including a nylong support roller adapted to slide beneath the slide arms of an upper seating section; and positive stop means mounted to engage the rear portion of the nose beam section of an upper seating section when its associated platform support means is in a fully extended position.

13. In a telescoping seating system including a plurality of telescoping seating row sections, the improvement for each section comprising: carriage means including a pair of upright support posts; an elongated metal riser beam connected to said posts and including a vertical web defining a horizontally elongated slot, housing means integral with said web and extending behind said slot to provide a channel having upper and lower horizontal channel walls extending rearwardly of said web and located respectively above and below said slot, and rear wall means extending between the rear edges of said upper and lower channel walls; a plurality of seating units including pivotal attachment means; and fastener means for removably securing said attachment means to said beam at said slot and including an internally threaded nut having a height greater than the vertical spacing of said upper and lower horizontal channel walls and a width less than the height of said slot, said fastener further including a bolt for securing said attachment means to said web by placing said nut through said slot and turning until said nut engages said upper and lower horizontal channel walls, further turning of said bolt bringing said nut into engagement with said vertical web of said beam to secure said attachment means thereto; and means on said beam for preventing rotational motion of said attachment means when said attachment means is being assembled to said beam.

* * * * *